US005097879A

United States Patent [19]

Rice, Sr.

[11] Patent Number: 5,097,879

[45] Date of Patent: Mar. 24, 1992

[54] APPARATUS FOR MAKING WOOD CURLS

[75] Inventor: James T. Rice, Sr., Athens, Ga.

[73] Assignee: University of Georgia Research Foundation, Inc., Athens, Ga.

[21] Appl. No.: 633,588

[22] Filed: Dec. 21, 1990

[51] Int. Cl.[5] ..... B27C 1/00

[52] U.S. Cl. ..... 144/176; 144/162 R; 241/92; 407/36

[58] Field of Search ..... 407/34, 36, 53; 241/92; 144/162 R, 176, 232

[56] References Cited

U.S. PATENT DOCUMENTS 2,712,842 7/1955 Fahrni ..... 241/92
3,856,212 12/1974 Swatko ..... 144/176
4,875,631 10/1989 Bardos ..... 144/176

*Primary Examiner*—W. Donald Bray
*Attorney, Agent, or Firm*—Vincent J. La Terza

[57] ABSTRACT

A mechanized disc flaker for producing curled wood flakes having a rotatable disc plate, and one or more cutting knives mounted to the disc plate so as to provide for a slight "rake angle" defined in accordance with the invention as the angle made between the tool face and a plane perpendicular to the direction of tool travel. In a preferred embodiment, the apparatus includes rotatable and removable knife holders which permit the rake angle and the "cutting angle", defined in accordance with the invention as being the angle the cutting edge of the knife makes with the grain of the wood, to be modified to yield curled wood shavings having different geometries and characteristics. The preferred method of practicing the apparatus involves using a work piece having a certain moisture content which is directed against the work surface of the disc flaker using appropriate pressure all to provide for wood curls of desirable characteristics.

2 Claims, 5 Drawing Sheets

APPARATUS FOR MAKING WOOD CURLS

BACKGROUND OF THE INVENTION

1. Field of the Invention

The present invention is concerned with the production of wood curls for various applications, such as potpourri, packing material and animal litter. The apparatus of the invention employs a parallel to the wood grain, orthogonal cutting action at substantially low rake angles to form curled wood shavings. The invention permits adjustments so as to produce wood curls with different characteristics suitable for various applications.

2. Description of Prior Art

Myriad devices and methods for wood machining are known. Two basic processes predominate this art. A first process known as peripheral milling is largely concerned with manipulating the work piece to a desired shape and surface. Peripheral milling involves a rotary cutting process in which wood is removed in the form of single chips. The chips are formed by the intermittent engagement of the work piece by knives carried on the periphery of a rotating cutter head. The finished surface therefore consists of a series of individual knife traces generated by the successive engagement of each knife. A single surfacer with rotating cutter head illustrates the peripheral milling process.

A second process, employed by this invention, is known as orthogonal cutting. This process is primarily concerned with producing wood chips or flakes for various applications. In orthogonal cutting, the cutting edge is perpendicular to the direction of the relative motion of tool and work piece and the surface generated is in a plane parallel to the original work surface. A carpenter's hand plane illustrates orthogonal cutting.

Orthogonal cutting is utilized in various chipping machines. Such machines reduce pulpwood to more or less uniform chips required to manufacture chemical pulp. The uniform chips permit cooking liquor to penetrate the wood quickly, completely, and uniformly. Most chippers include a heavy rotating steel disc that is slotted on the face to receive chipping knives. Wood is presented to the rotating disc so that the knives remove chips. Wood chippers typically have a cutting action whereby the knives cut essentially through a cross section of the wood fibers to produce a flat, rough product. Orthogonal cutting is further utilized in wood flaking machines. Such machines cut flakes of more or less controlled dimensions. These flakes, or particles, are used in making particle board.

The design of flakers is influenced by the form of the raw material introduced to the equipment, moisture content of the wood, the shape of flake desired, and the rate of production required. Peripheral milling, lathe, and disc type flakers are well described in the art.

A key factor in determining the shape of a chip or flake is the rake angle. In the nomenclature of wood machining, the rake angle is often defined as the angle made between the tool face and a plane perpendicular to the direction of tool travel. Rake angle is also sometimes referred to as the hook angle, the chip angle, or the angle of attack. The pulp and paper and particle board industries require flat chips and flakes. The prior art and literature teach the use of rake angles in the range of forty-five degrees to sixty degrees (45°-60°) to produce flat wood particles and teach away from the production of curled flakes.

U.S. Pat. No. 2,936,008 to Brown teaches a mobile chipping unit capable of producing flat wood chips from whole trees.

U.S. Pat. No. 2,969,095 to Bookhyser et al. teaches a feeding apparatus for a rotary wood flaker used in producing wood flakes for hardboard.

U.S. Pat. No. 3,032,281 to Wexell teaches a wood chipping machine having a rotatable chipper disc carrying a plurality of circumferentially spaced cutter knives with a particular securing means to secure the knives to the disc. Wexell teaches an elongated bolt head to ease in securing the knives to the disc and thus decrease the machine down time.

U.S. Pat. No. 3,237,663 to Kirster discloses a wood chipping apparatus for making chips where the feeding channel is designed to guide the wood pieces to the cutter so that the pieces will be cut either parallel or perpendicular to the wood grain.

U.S. Pat. No. 4,346,744 to Beer et al. teaches a wood waferizing apparatus designed with cutter knives that hold the wood piece stationary and cut it substantially parallel to the wood grain.

U.S. Pat. No. 4,298,044 to Hansel et al. teaches a wood chipper having angularly space knife blades mounted on a rotating disc. The angularly spaced knife blades are adjacent to angularly spaced passageways where the wood is fed to the other side of the disc.

U.S. Pat. No. 4,685,497 to Mierau et al. teaches a wood waferizing apparatus having serrated, staggered disposable knives.

The above mentioned art discloses methods and machinery for producing flat wood chips, flakes or fibers. The rake angles used in the cited prior art are substantial.

The present invention is related to but distinct from disc flakers known in the prior art. The present invention, unlike the prior art, utilizes a relatively small rake angle to produce a wood curl instead of a flat wood chip or flake. Another factor important in producing durable and substantial wood curls is wood grain orientation. A notation developed by W. M. McKenzie and published in *Fundamental Analysis of the Woodcutting Process* by Peter Koch (Ronald Press Company, 1964, p. 36), is useful in describing wood grain orientation in the orthogonal cutting situation. This system consists of two numbers separated by a hyphen. The first number is the angle the cutting edge of the knife makes with the grain of the wood (hereinafter "cutting angle"). The second number is the angle that the tool motion vector makes with the grain of the wood. The vast majority of chippers and flakers known in the prior art have a cutting action described by the referenced nomenclature as 0–90. This means that at each instant as the blade moves through the wood its cutting edge is parallel to the grain but the motion of the blade is perpendicular to the grain. The cutting action for the present invention, in contrast, is described in accordance with the referenced nomenclature as 90-5. This means that the knife edge is perpendicular to the grain and the knife motion is at a slight angle to the grain.

Curled wood flakes have many applications. Predominant uses are for packing and potpourri material. A commonly used packing material is polystyrene in the form of peanuts, worms, and shells. Although polystyrene has certain qualities which render it suitable for packing material, it has come to be recognized as an environmentally harmful substance. The chemicals used in the production of polystyrene are associated with depletion of the ozone layer of the atmosphere. Polystyrene is not biodegradable.

Long, thin, grass-like wood shavings, sometimes referred to as excelsior or wood wool, have also been used as packing material. Such material does not readily conform to the shape of the packaged object. Therefore, more labor is required to package an object with it. Such material also releases dust particles which may damage the packaged item and be untidy.

Paper is also used as a packing material. It is not as readily disposable as either excelsior or the wood curls produced by the present invention. Also, it may be necessary to use an amount of paper having a greater than desirable bulk density in order to adequately protect the packaged item.

Curled wood shavings produced in accordance with this invention are lightweight, relatively dust free, elastic, inexpensive and environmentally safe to manufacture and use. Curled shavings can be poured around an object being packed. They conform to its shape and require less manual arrangement than excelsior-like materials.

A second important application for wood curls is for potpourri materials. Traditionally, potpourri mixtures have been comprised of dried herbs and flowers. Recently, other materials such as stone, ceramic pieces and wood shavings have been treated with fragrant oil and added to potpourri. The wood shavings currently used in potpourri are typically flat wood scraps from industrial wood peripheral milling operations. These scraps tend to break up and splinter. They are also not very decorative and do not enhance the appearance of a potpourri mixture. Curled shavings are very decorative. They are also far more elastic and less subject to splintering than flat wood scraps. Curled shavings have greater surface area than flat wood scraps and therefore emit more fragrance.

SUMMARY OF THE INVENTION

The present invention provides devices and methods for mass producing curled wood flakes for various uses, such as packing, potpourri, and animal litter material.

According to one device of the present invention, one or more cutting knives are nonadjustably mounted to the work surface of the disc of a disc flaker. The knives are set to rake angles in the range of zero degrees to thirty degrees (0°-30°). The orientation of the grain of the work piece relative to the motion of the knife is an important factor in producing curls of different geometry and characteristics. The feed box and the work piece should be positioned relative to the work surface of the disc flaker so as to provide for a knife motion at a slight angle, in the range of two degrees to ten degrees (2°-10°), to the grain of the wood. The orientation of the feed box and work piece relative to the work surface of the disc should further provide for a cutting action that is "with-the-grain" of the wood. In the terminology of wood machining, a disc flaker knife cutting down the face of a wood block, the grain of which is at an angle of five degrees (5°) off the vertical and with the grain lines of the wood leaning back and away from the disc and the knife, would be designated as making a ninety degree to five degree (90°-5°) with-the-grain cut.

According to another device of the present invention, the cutting knives are adjustably mounted to the work surface of the disc flaker. The knives are mounted using removable knife support inserts mounted in rotatable knife holders. The knife support inserts are machined so as to provide for various rake angles in the range of two to thirty degrees (2°-30°) when mounted with a knife in the knife holder. The ability to rotate the knife holders allows for the cutting angle between the knife edge and the grain of the wood to be adjusted. This angle is critical with respect to the shape and geometry of the curls produced. When this angle is approximately ninety degrees (90°), a non-helical curl is produced. When this angle is adjusted to approximately forty-five degrees (45°), a helical curl is produced. Helical curls interlock and therefore better stabilize a packaged item within its packing container than non-helical curls. Different rake angles and different angles between the cutting edge of the knife and the grain of the wood yield curls optimal for various packing and potpourri applications. The ability to vary these two angles is also useful in achieving standard curls with various types of work pieces.

In all devices of the invention, the disc should include arrays of scoring holes positioned so that small cutting blades may be inserted in them to provide for the production of curls of varying length. In all devices of the invention, the feed box should be positioned so as to allow for full conversion of the blocks of wood used to make curls. This may be achieved by positioning the base of the feed box very close to the cutting plane of the knife edges, preferably within a distance less than a thickness of a curl.

All devices of the invention should be designed to facilitate curl removal. In one such embodiment, the disc would be mounted in bearings on the side of a heavy metal channel frame with the disc positioned so that about forty percent (40%) of it is the channel and about sixty percent (60%) above the channel. The curls produced by the cutting action would be directed toward a conveyor belt which would receive the curls and transport them to an appropriate accumulation container.

An important element of the method of using the invention is to use fully green wood with a moisture content of at least thirty percent (30%). Excessively dry wood often fails to produce well formed curls of substance. The distance the knife is set to project beyond the face of the disc, in combination with the amount of pressure used to force the work piece against the disc and knife, plays a role in determining the thickness of the curls. Shavings which are too thin may not curl properly and may possess low compression resistance. Shavings which are too thick also may not curl properly and may have higher bulk densities than desirable for use as a packing material. The height of the wood block plays an important role in determining the diameter of the curls produced.

It is accordingly an object of this invention to use a disc flaker having knives with low rake angles to cut wood pieces to create curled flakes.

It is an additional object of this invention to provide a means for adjustably mounting knives on a disc flaker so as to enable one to vary the rake angle and the angle between the knife edge and the grain of the wood to provide for curled flakes with different characteristics and to accommodate the characteristics of different wood pieces.

It is a further object of this invention to position the feed box so as to present the grain of the work piece to the blade, such that the angle the tool motion vector makes with grain is in the range of two degrees to ten degrees (2°–10°).

It is a further object of this invention to include scoring blades on the disc work surface to permit the creation of curled flakes of various length.

It is a further object of this invention to position the feed box to permit convenient removal of curled flakes and to permit full conversion of wood pieces to curled flakes.

It is a further object of the method of this invention to use wood of appropriate moisture content and temperature so as to produce curls having the desired characteristics for specific applications.

It is a further object of the method of this invention to control the feed pressure of the device to produce curls of the desired shape and characteristics.

Other objects, features and purposes of the invention will become apparent with respect to the remainder of this document.

DESCRIPTION OF THE DRAWINGS

The invention will now be described with reference to the accompanying drawings, which illustrate the preferred embodiments of the mechanized disc flaker of the present invention falling within the scope of the appended claims. For purposes of description the "front" of the disc shall mean the side facing the work piece. The "rear" of the disc shall mean the opposite side through which cut curls are ejected.

DETAILED DESCRIPTION OF THE PREFERRED EMBODIMENT

Figure 1:
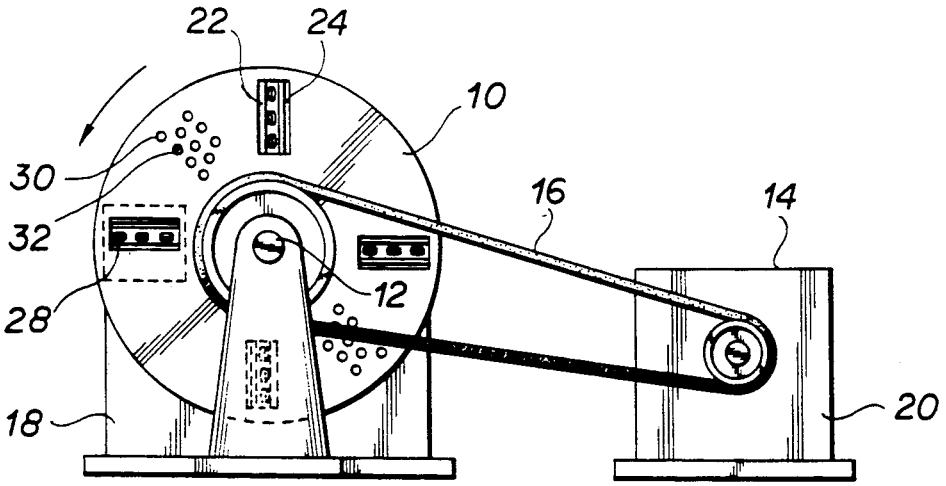
FIG. 1 is a rear view of the mechanized disc flaker illustrating the rotational direction of the disc.

Referring to FIG. 1 the apparatus consists of a disc plate 10 rotating about a shaft 12. In order to permit an adequate production of curls, the disc should be at least eighteen inches (18") in diameter and be able to accommodate knives at least four inches (4") in length. The shaft 12 is driven by an electric motor 14 by means of a continuous drive belt 16. Both the disc flaker housing 18 and motor housing 20 are securely mounted to adjacent structures to enable the apparatus to perform properly and without structural or alignment difficulties.

Figure 2:
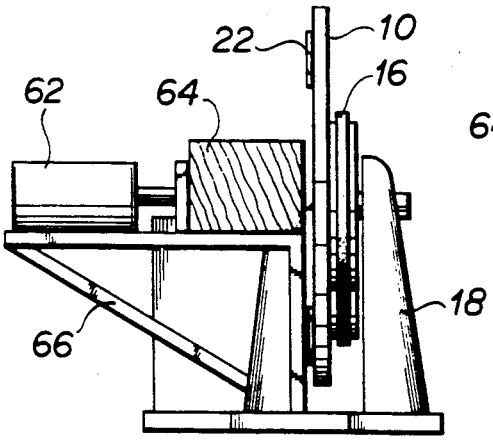
FIG. 2 is a side view of the disc flaker showing the pneumatic jack pushing the work piece into the work surface of the flaker.
Figure 3:
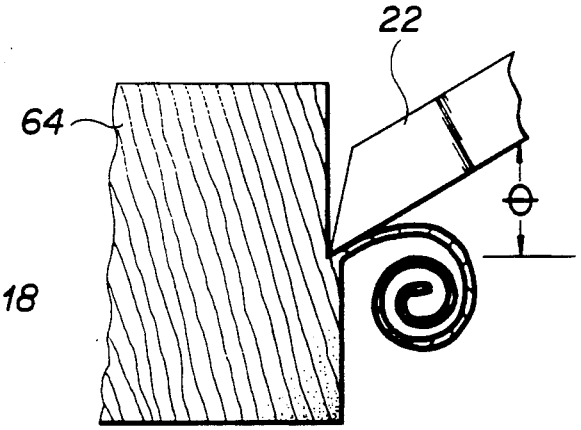
FIG. 3 is a side view of a work piece being cut substantially along and with the wood grain by a cutting knife with a rake angle of approximately thirty degrees (30°)

FIG. 2 illustrates that a pneumatic jack 62 is used to direct the work piece 64 into the face of the disc plate 10. The jack 62 is structurally supported by flanges 66 extending from the disc flaker housing 18.

The electric motor 14 drives the disc flaker using a continuous belt 16. As the disc plate 10 rotates, each blade 22 cuts into the wood piece 64. Constant pressure provided by the pneumatic jack 62 continuously feeds the disc flaker. The blade 22 cuts through the work piece at a slight knife angle, cutting substantially with and along the wood grain to produce a curled wood flake.

Figure 4:
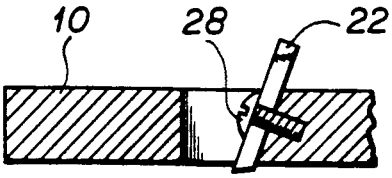
FIG. 4 is a sectional side view of a cutting blade nonadjustably mounted to the disc using a bolt and having a low rake angle.
Figure 5:
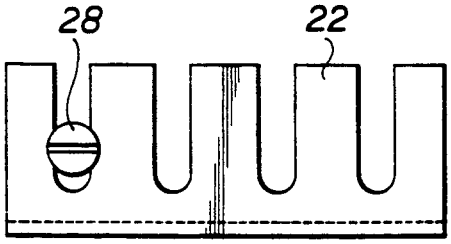
FIG. 5 is a detailed front view of a blade with elliptical grooves to receive mounting bolts.

Structurally integral with the disc plate 10 are the knife blades 22. The knife blades 22 are mounted in accordance with FIG. 4 directly to the disc 10 using a mounting bolt 28. The knife blade 22 shown in FIGS. 2 and 4 is mounted and ground so as to have a low rake angle. The preferred rake angle is in a range from zero degrees to thirty degrees (0°–30°).

Figure 6:
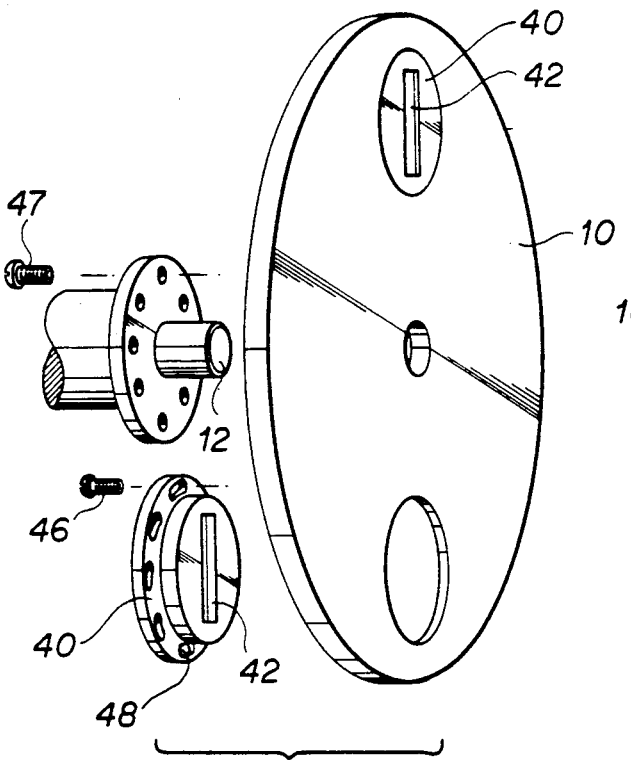
FIG. 6 is an exploded perspective of a disc with two knife holders radially aligned and further showing the shaft and bolts for mounting the main disc to said shaft.
Figure 7:
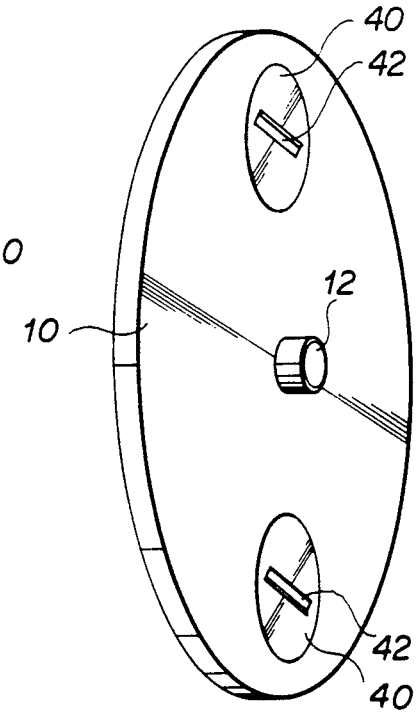
FIG. 7 is a perspective view of a disc with two knife holders rotated forty degrees (40°)
Figure 9:
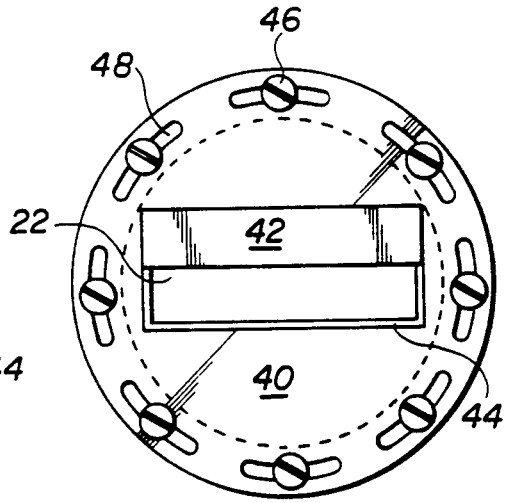
FIG. 9 is a rear view of a removable and rotatable knife holder disc.

In another preferred embodiment, the knives are mounted on the main disc using removable and rotatable knife holder discs. In accordance with FIGS. 6, 7, and 9, the removable and rotatable knife holder discs are adjustably mounted to the main disc. The knife holder discs 40 are mounted to the main disc 10 using a series of knife holder disc mounting bolts 46 which screw through elliptical slots machined into the periphery of the knife holding discs and into the main disc. In accordance with FIG. 9, the elliptical slots may be adjusted by loosening the screws, adjusting the position of the slots, and retightening the screws so that various angles may be made between the cutting edge of the knife and the grain of the work piece.

Figure 8:
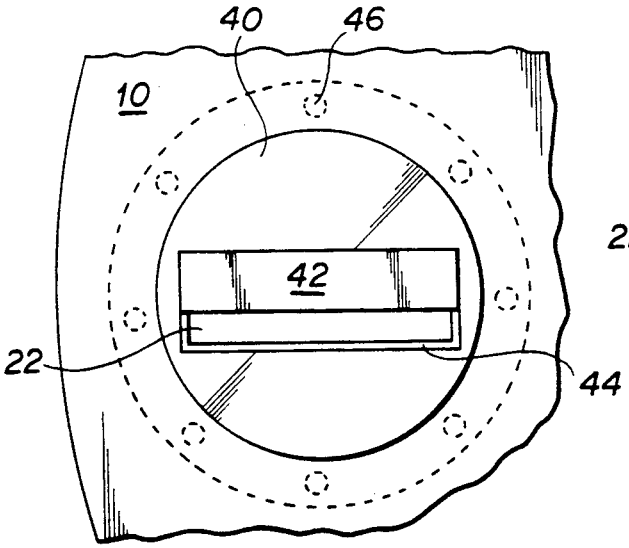
FIG. 8 is a partial cut-away section of a main disc viewed from the rear and showing a removable and rotatable knife holder disc mounted to the section.

As shown in FIG. 8, there is an opening 44 for curl passage after a curl is cut from the work piece.

Figure 10:
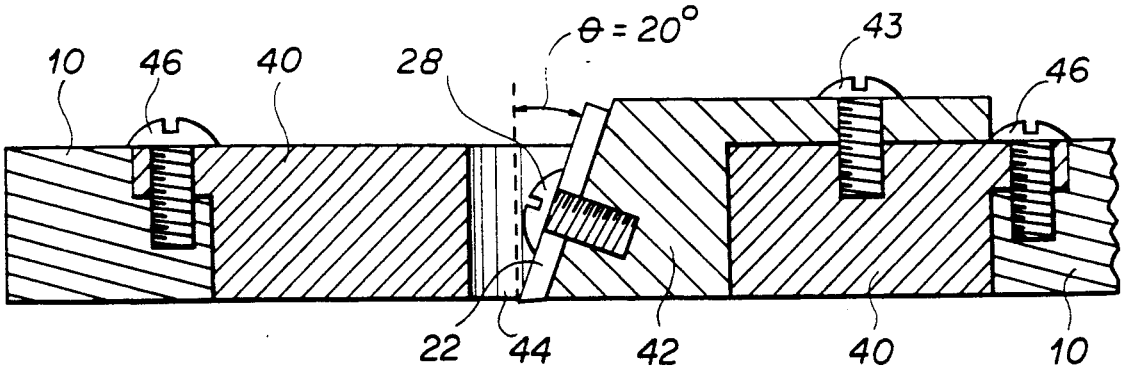
FIG. 10 is a side view cut-away of a removable and changeable knife support insert allowing for a knife to be mounted at twenty degrees (20°)
Figure 11:
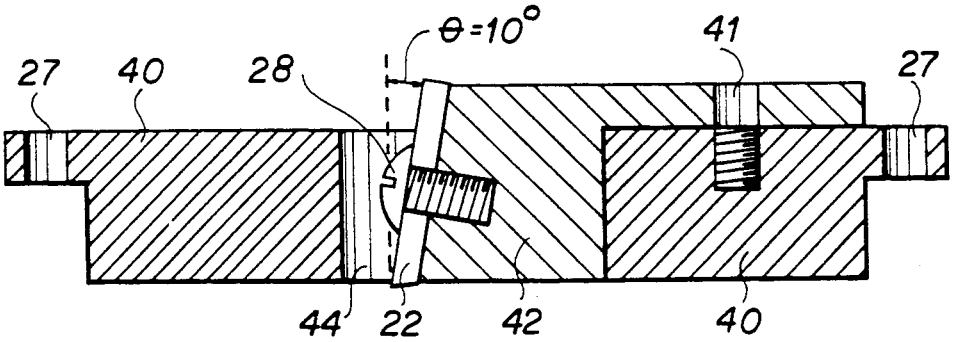
FIG. 11 is a side view cut-away of a removable and changeable knife support insert which allows for mounting a knife at ten degrees (10°)
Figure 12:
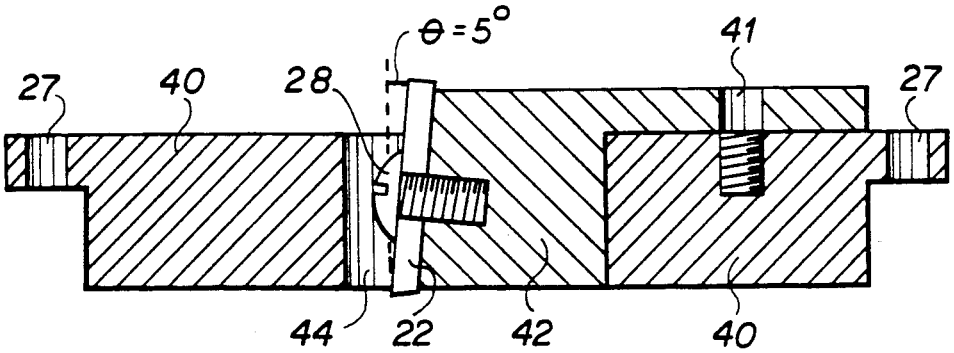
FIG. 12 is a side view cut-away of a removable and changeable knife support insert which allows for mounting a knife at five degrees (520 )

As illustrated in FIGS. 10, 11, and 12, the rotatable and removable discs may include knife holder inserts 42 which allow for knives to be mounted with various rake angles. The knives 22 are mounted to the removable and changeable knife support inserts 42 using a mounting bolt 28. The inserts are mounted to the knife holders using bolts 43. The knife holder is in turn mounted to the main disc using bolts 46.

Figure 18:
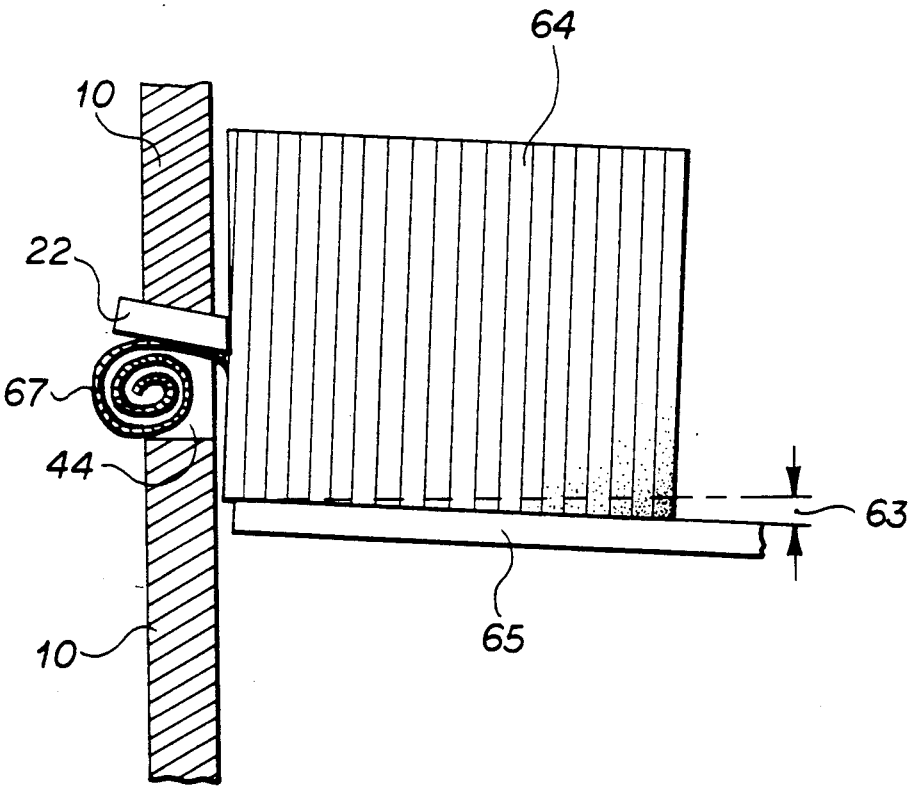
FIG. 18 is a side view cut-away showing a feed box with an angled platform allowing for an appropriate angle of knife motion to the wood grain.

FIG. 18 illustrates that an appropriate angle of knife motion to the wood grain of the work piece is achieved in this apparatus through the use of an angled platform upon which the work piece is mounted. The bottom corner of the wood block facing the disc should be indexed against the disc to permit complete conversion of the wood block into curls.

Figure 13:
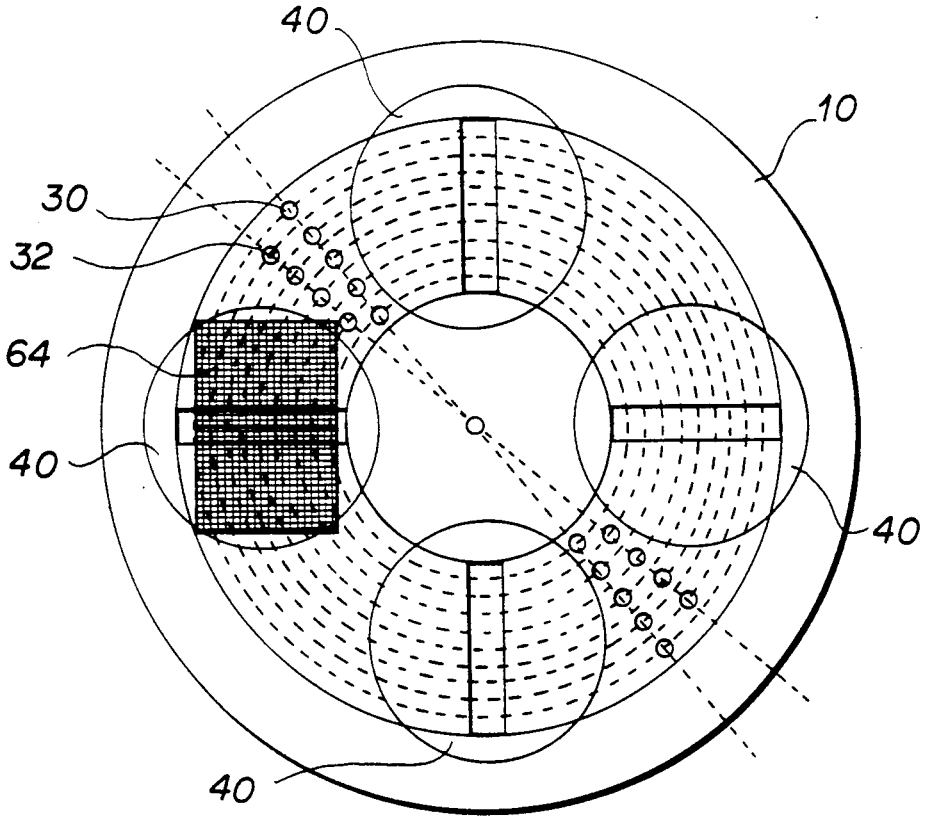
FIG. 13 is a rear view of a main disc with four knives mounted in removable and rotatable knife holders.
Figure 14:
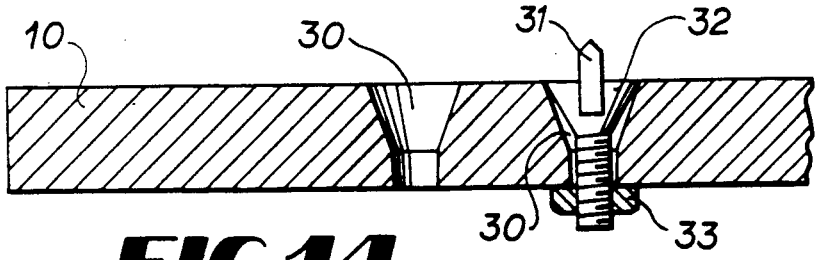
FIG. 14 is a sectional view of a main disc showing detail of a scoring knife and mounting hole.
Figures 15, 16, 17:
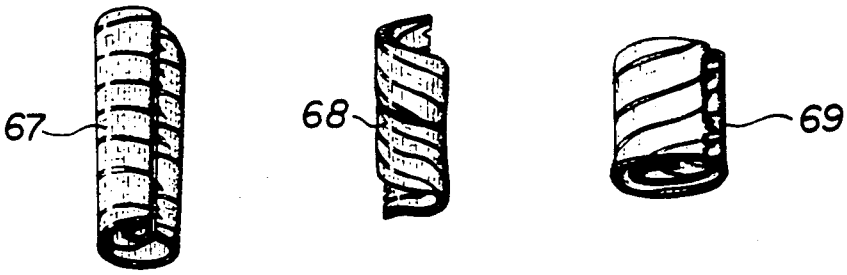
FIGS. 15, 16, and 17 are details of curls produced by the disc flaker.

FIG. 13 illustrates scoring knife mounting holes 30 and scoring knives 32 which extend radially along the face of the disc plate 10. Scoring knives 32 are held within the scoring holes 30 by an interference fit. The scoring holes should be approximately one-half inch (½") apart. A scoring knife 31 may be mounted in a scoring knife holder 32 which may be inserted in a scoring mount scoring hole 30. The scoring knife may be tightened within its holder using a tightening nut 33. FIG. 14 is a magnified cut-away view of a scoring knife mounting hole and a scoring knife mounted in a scoring knife mounting hole. As the disc plate 10 rotates, the scoring blades 32 cut the wood in lengthwise strips. The width and number of flakes depend on the number of scoring blades used.

In order to facilitate curl removal, it would be convenient to mount the disc in bearings on the sides of a heavy metal channel frame with the disc positioned so that about 40% of it is in the channel and about 60% above the channel. The feed box should be adjustable so that its base could be positioned within the range of from approximately 3–4" below the centerline of the disc up to approximately the centerline of the disc.

In order to fully convert the blocks of wood used to curls and avoid thick end pieces slipping by at the end of each block, the base of the feed box must be positioned very close to the cutting plane of the knife edges, preferably within a distance less than the thickness of a curl. To do this safely and minimize the risk of metal contacting metal during operation, it would be useful to have replaceable lips of wood or some other machinable material on the leading edges of the feed box bottom and sides.

Although the preferred embodiment of this invention has been described in detail, it is contemplated that modifications thereof may be made and some preferred features may be used without others, all within the spirit and scope of the broad invention.

I claim:

1. An apparatus for making wood curls comprising:

(a) a rotatable disc having a work surface on the face of said disc and one or more circular openings near the edge of said disc and a plurality of bolt mounting holes on the periphery of said openings on the side of the disc opposite the work surface, and having a hollow center suitable for mounting said disc on a shaft;

(b) one or more circular, rotatable, and removable cutting blade holders mounted in said openings which include in the center of the holders elongated and narrow slots for receiving cutting blades and further include on the periphery of the holders elliptical mounting bolt holes for receiving mounting bolts;

(c) means for fixably attaching cutting blades to said rotatable and removable cutting blade holders whereby a slight rake angle is made between the face of said cutting blades and a plane perpendicular to said work surface of said disc;

(d) a shaft upon which to securely mount said disc;

(e) a means for directing wood pieces against said work surface with the grain of said wood pieces being substantially parallel to and with the rotational direction of said disc as it rotates about said shaft causing said series of cutting blades to travel and contact the wood pieces; and (f) sufficiently powerful means for causing said shaft to rotate with sufficient speed and force so as to permit said cutting blades to cut said wood pieces to produce curled wood flakes.

2. The apparatus of claim 1 wherein the means for fixably attaching said cutting blades to said cutting blade holders whereby a slight rake angle is made between the face of said cutting blades and a plane perpendicular to said work surface of said disc comprises knife mounting inserts beveled so as to provide for rake angles in the range of zero to thirty degrees (0°–30°), said inserts including bolt holes for mounting said inserts to said rotatable and removable knife holders and bolt holes for receiving bolts for mounting said cutting knives to said inserts.

* * * * *